US008468721B2

(12) United States Patent
Sokolowski

(10) Patent No.: US 8,468,721 B2
(45) Date of Patent: Jun. 25, 2013

(54) FOOTWEAR WITH INTEGRATED BIASED HEEL FIT DEVICE

(75) Inventor: Susan Sokolowski, Portland, OR (US)

(73) Assignee: Nike, Inc., Beaverton, OR (US)

( * ) Notice: Subject to any disclaimer, the term of this patent is extended or adjusted under 35 U.S.C. 154(b) by 118 days.

(21) Appl. No.: 13/222,056

(22) Filed: Aug. 31, 2011

(65) Prior Publication Data

US 2011/0308109 A1 Dec. 22, 2011

Related U.S. Application Data

(62) Division of application No. 11/696,733, filed on Apr. 5, 2007, now Pat. No. 8,020,317.

(51) Int. Cl.
*A43B 3/26* (2006.01)

(52) U.S. Cl.
USPC ..... 36/69; 36/68; 36/58.5; 36/9; 36/105

(58) Field of Classification Search
USPC ..... 36/89, 90, 92, 93, 102, 58.5, 58.6, 36/68, 69
See application file for complete search history.

(56) References Cited

U.S. PATENT DOCUMENTS

| | | | | |
|---|---|---|---|---|
| 81,690 | A * | 9/1868 | Savoy | 36/68 |
| 178,387 | A | 6/1876 | Simpson | |
| 236,705 | A * | 1/1881 | Howe et al. | 36/68 |
| 256,030 | A | 4/1882 | Morton | |
| 452,853 | A * | 5/1891 | Siegrist | 36/69 |
| 551,759 | A * | 12/1895 | Donovan | 36/68 |
| 892,601 | A * | 7/1908 | Lucke | 36/68 |
| 912,579 | A * | 2/1909 | Krech et al. | 36/58.5 |
| 1,091,704 | A | 3/1914 | Preble | |
| 2,693,039 | A * | 11/1954 | Balut | 36/58.5 |
| 2,936,533 | A * | 5/1960 | Paynor | 36/105 |
| 2,942,359 | A | 6/1960 | Bushway et al. | |
| 3,425,075 | A | 2/1969 | Murray | |
| 3,613,274 | A | 10/1971 | Willey | |
| 4,308,673 | A | 1/1982 | Mobius | |
| 5,152,082 | A | 10/1992 | Culpepper | |
| 5,291,671 | A | 3/1994 | Caberlotto et al. | |
| 5,408,761 | A | 4/1995 | Gazzano | |
| 5,946,825 | A | 9/1999 | Koh et al. | |
| 6,000,148 | A * | 12/1999 | Cretinon | 36/88 |
| 6,079,128 | A | 6/2000 | Hoshizaki et al. | |
| 6,401,366 | B2 | 6/2002 | Foxen et al. | |
| 6,497,058 | B2 * | 12/2002 | Dietrich et al. | 36/69 |
| 7,059,069 | B2 | 6/2006 | Raluy et al. | |
| 7,168,188 | B2 | 1/2007 | Auger et al. | |
| 7,178,270 | B2 | 2/2007 | Hurd et al. | |
| 2005/0081404 | A1 | 4/2005 | Hurd et al. | |
| 2006/0010718 | A1 | 1/2006 | Auger et al. | |

OTHER PUBLICATIONS

Gordon et al., Anthropology Research Project, Inc.,;1988 Anthropometric Survey of U.S. Army Personnel: Summary Statistics Interim Report, Mar. 1989; pp. 23, 96 and 97; U.S. Army Natick Research, Development and Engineering Center, Natick, MA.

* cited by examiner

*Primary Examiner* — Jila M Mohandesi
(74) *Attorney, Agent, or Firm* — Plumsea Law Group, LLC

(57) ABSTRACT

A shoe structure specifically designed to more securely fit a wider range of feet widths and proportions by providing an integrated resilient heel device in the rearfoot region of the upper. The heel device extends upward and rearward toward the back of the foot to avoid the bulbous end of the calcaneus but also to engage the area just above the heel bone. The heel device has opposing portions that are biased toward one another and provide a secure but comfortable engagement of the shoe onto the wearer's heel. The heel device is smaller than the size of the shoe into which it is incorporated to enhance the biasing effect of the opposing portions.

20 Claims, 16 Drawing Sheets

| Men vs. Women Variability | | | | | | |
|---|---|---|---|---|---|---|
| | ← Distance from back edge (mm) | | | | | |
| Distance from footbed (mm) ↑ | 60 | 50 | 40 | 30 | 20 | 10 |
| 60 | ○ | ○ | ○ | ◐ | ◐ | ○ |
| 50 | ○ | ○ | ○ | ◐ | ○ | ○ |
| 40 | ○ | ○ | ○ | ○ | ○ | ● |
| 30 | ○ | ○ | ○ | ○ | ○ | ● |
| 20 | ○ | ○ | ○ | ○ | ○ | ● |
| 10 | ○ | ○ | ○ | ○ | ○ | ● |

○ -1.5mm to 1.9mm

◐ 2.0mm to 3.4mm

● 3.5mm to 5.9mm

Fig. 8

FOOTWEAR WITH INTEGRATED BIASED HEEL FIT DEVICE

CROSS-REFERENCE TO RELATED APPLICATION(S)

This application is a divisional of U.S. patent application Ser. No. 11/696,733, filed Apr. 5, 2007 and issued on Sep. 20, 2011 as U.S. Pat. No. 8,020,317, the entirety of which is hereby incorporated by reference.

BACKGROUND

1. Field of the Invention

This invention relates to a heel element for footwear, and more particularly to a resilient heel device for athletic footwear designed to provide a secure anatomically appropriate fit for a larger range of foot sizes and shapes.

2. Background of the Invention

The design of most athletic footwear is directed to its performance and takes into account the intended use of the shoe such as the type of activity or playing surface. For example, mid or high top ankle collars are provided for activities that may involve jumping so as to stabilize and support the ankles of the wearer. Likewise, the degree of cushioning is determined by the intended activity, and outsole treads are selected for the type of playing surface for which the shoe is intended. These performance related determinations are important parameters for footwear design, but they have generally not included considerations for the fit of the shoe on the wearer's foot.

Fit is somewhat of a subjective criterion since each wearer will find comfort in varying degrees of tightness about the foot. There are fit criteria that are more objective such as the measured length of the foot and the measured width of the foot at various points. The width measurement is usually taken in the metatarsal region which correlates to the widest portion of the foot. Most footwear fitting is done with only the single width measurement at the metatarsals. Even though the human foot is a complex engineering marvel with a great degree of variability from person to person, conventional fittings only use that single width measurement.

For the most part, athletic footwear has been designed for the anatomy of a man's foot of statistically average dimensions. This statistically average man's foot generally has larger proportions such as a higher or thicker instep, wider overall span and a larger and wider heel, as compared to a large number of people with narrower or thinner feet with more variance between the forefoot width and the heel width. Footwear sizing is generally based on statistical averages of measurements, often of male feet. The same proportions are generally scaled up or down linearly or evenly to provide all shoe sizing for a given manufacturer. Half of the population, namely women, have feet that will vary from the statistical average man's foot to a greater degree, and a shortcoming of this approach is the failure to recognize the different anatomical proportions of a woman's foot as compared to a man's foot. Although width sizing helps with fit, the overall proportions of a shoe designed for a male foot does not always provide the best fit on a majority of female feet. This is also true of many male feet that do not fall within the statistically average proportions.

The variability in feet even within the same size is a fact recognized in the footwear industry. This explains the plethora of footwear accessories such as insoles, pads, clips, inserts, etc. that are sold to enhance the fit of shoes. All wearers, and particularly women, spend extra money on these types of inserts and devices to try to make existing shoes fit better. These types of devices can themselves be the cause of problems and even lead to injuries such as abrasion and blisters, particularly when used in athletic footwear in which the user subjects the shoes to higher impacts, quicker stops and starts and turns as compared to dress shoes. It would be advantageous to provide a shoe that can fit a wider range of feet anatomically so that reliance on add-on accessories such as heel pads and clips can be eliminated.

SUMMARY

The present invention addresses the shortcomings of conventional athletic footwear by providing a shoe structure specifically designed to more securely fit a wider range of feet widths and proportions. This is particularly, but not exclusively, applicable to designing footwear for the female foot. The footwear described herein includes a resilient heel device that has opposing portions biased toward one another and adapted to engage the heel and Achilles area of the wearer's foot to provide a more secure fit. The biasing may be achieved in a number of ways. One manner contemplated is to integrate a heel device that is smaller in size than the heel area of the shoe to which it is attached. This will enhance the biasing effect of the heel device and ensure that the heel area of the shoe will snugly fit the heel and Achilles area of the wearer's foot. The heel device is an integral element which may be a single molded piece, or a combination of multiple pieces operating as one.

In one aspect of the invention, the article of footwear comprises an upper, an insole, a cushioning midsole and a ground-engaging outsole, and defines a forefoot region, a midfoot region and a rearfoot region. The upper has an opening for receiving a wearer's foot and an ankle collar surrounding at least a portion of said opening, and comprises an integrated resilient heel device attached to extend upward from said midsole in the rearfoot region. The heel device has opposing portions biased toward one another to secure the footwear to the wearer's foot.

In another aspect of the invention the resilient heel device also comprises a lower bridge portion connecting the biased opposing portions. The lower bridge portion may underlay the upper.

In another aspect of the invention the resilient heel device also comprises a rear foot portion extending from each of the opposing portions and together cups the heel of the wearer to provide a more secure fit.

In yet another aspect of the invention at least a portion of the resilient heel device is attached to the upper.

In another aspect of the invention the heel device is sized smaller than the heel area of the shoe into which it is attached to enhance the biasing effect of the opposing portions.

In another aspect of the invention, an athletic shoe defines a forefoot region, a midfoot region and a rearfoot region and is adapted to receive a wearer's foot having corresponding anatomical regions. The shoe comprises an upper for surrounding at least a portion of the midfoot region of the wearer's foot, and includes an insole forming a bottom of the upper for receiving the sole of the wearer's foot. The shoe also comprises a midsole attached to the upper for providing cushioning and stability, and an outsole having a tread surface for providing ground-engaging traction and stability. A resilient heel device is attached to and incorporated into the shoe in the rearfoot region, and the heel device has biased opposing portions attached to the upper and an integrated bridge portion underlying the upper and attached between the upper and the midsole.

In another aspect of the invention, each of the opposing portions of the heel device includes an upwardly extending forward leg having a forwardmost point at a front transition angle, and an inclined portion extending upwardly and rearwardly from said front transition angle.

In yet another aspect of the invention, each of the opposing portions of the heel device includes a rear transition angle between the inclined portion and the rear portion, the rear transition angle being the highest point of the heel device.

In another aspect of the invention, the heel device is a two-piece element with an interlocking configuration where the two pieces are joined together in the shoe. The two-piece configuration of the heel device could facilitate manufacturing steps to attach a heel device of a smaller size than the heel area of the shoe.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings:

FIG. 8 contains Table 1: Men vs. Women Variability showing a summary of the measurements taken in conjunction with the grid in FIG. 7.

DETAILED DESCRIPTION

Figure 1:
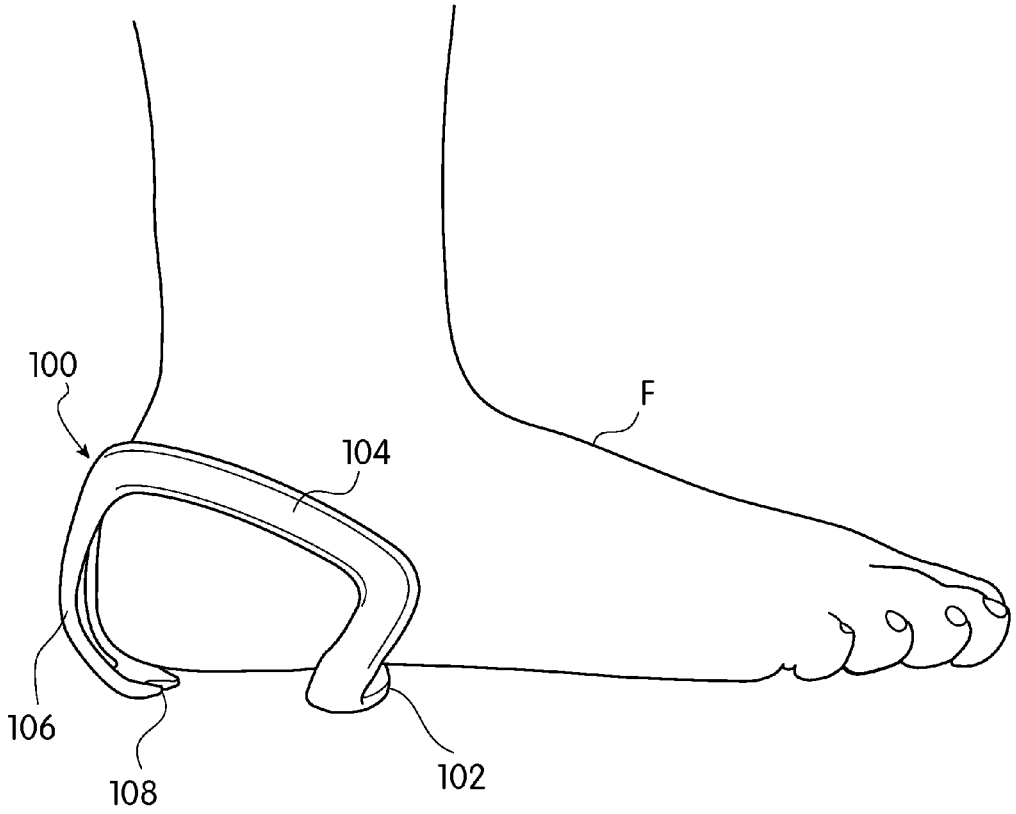
FIG. 1 is a side elevational view of a heel device shown on a foot.
Figure 2:
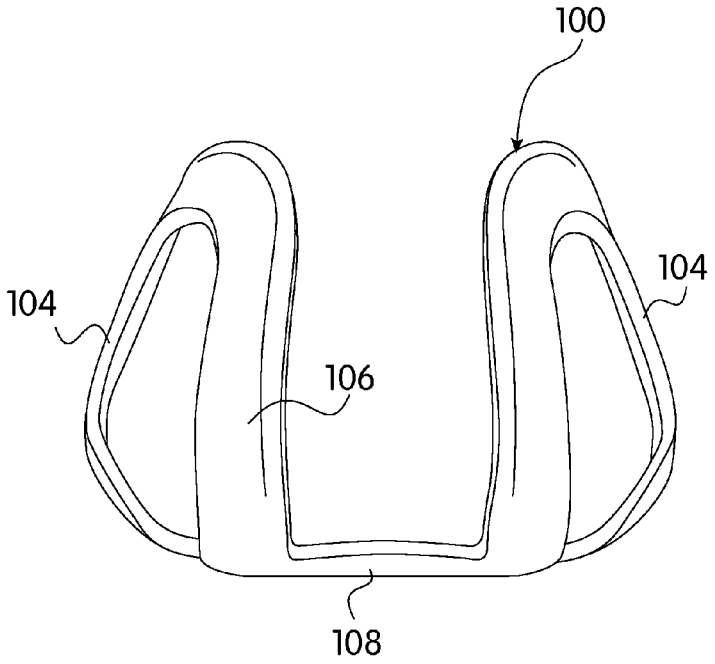
FIG. 2 is a rear elevational view of the device of FIG. 1.
Figure 3:
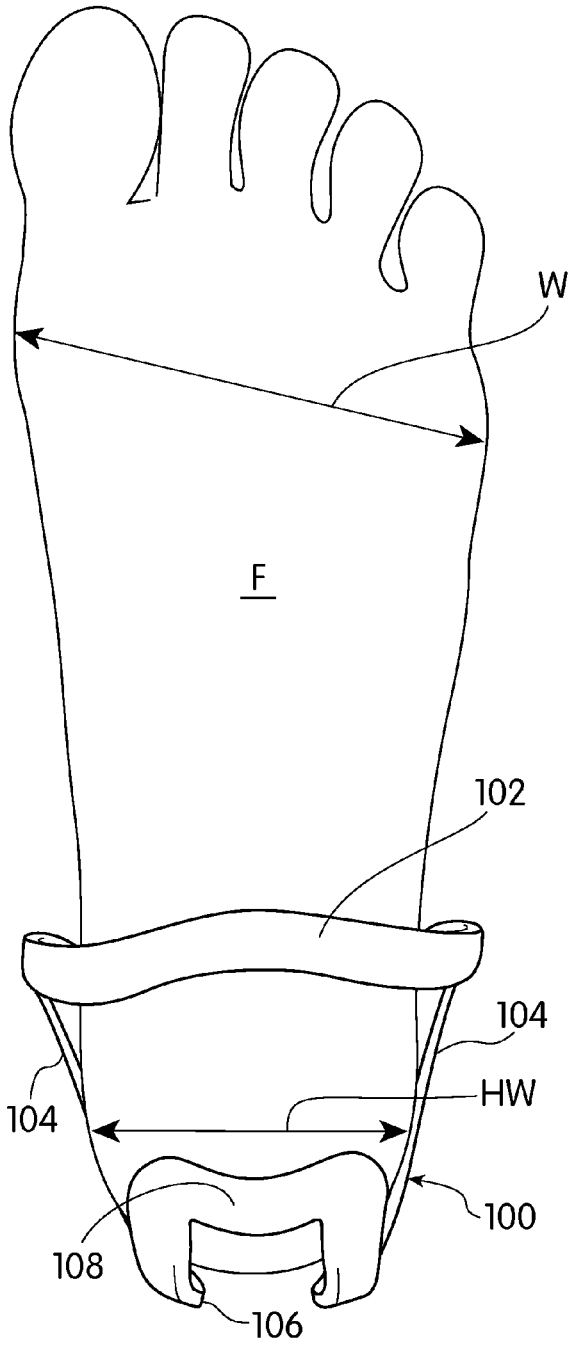
FIG. 3 is a bottom plan view of the device of FIG. 1.
Figure 10:
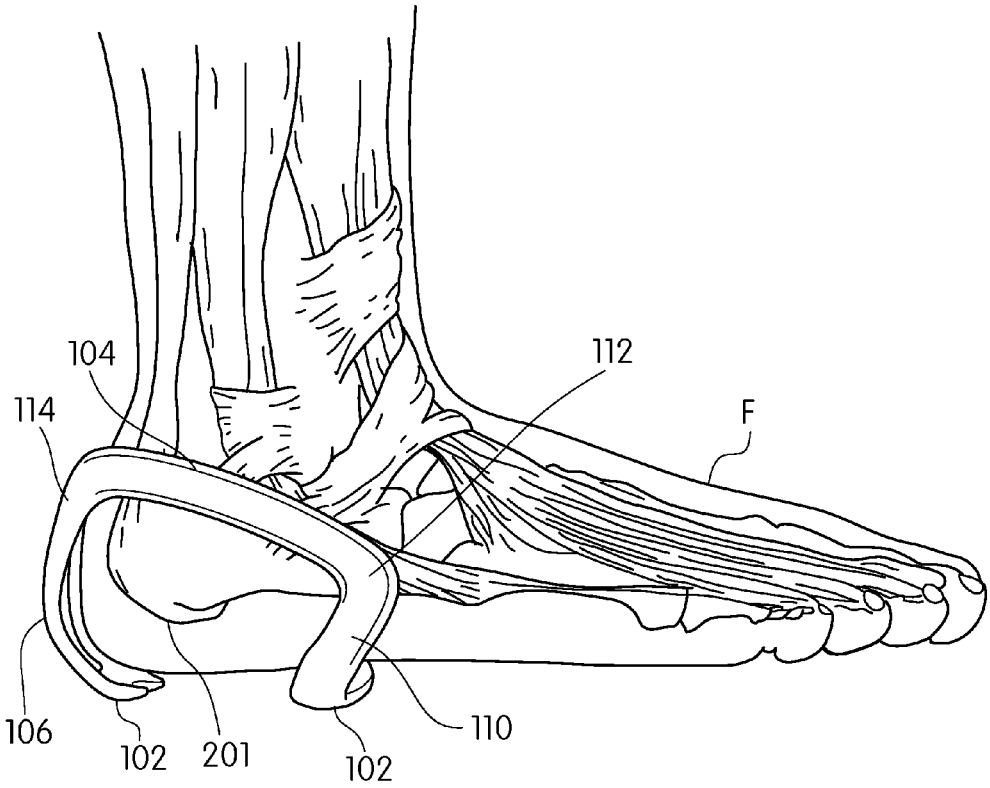
FIG. 10 is a schematic side view of a foot similar to FIG. 4, but showing the heel device in place.

Resilient heel device 100 is shown schematically on a foot F in FIGS. 1 and 3, and in isolation in FIG. 2. These views along with FIG. 10 are intended to show how the heel device is placed relative to the anatomy of the foot. It should be understood however, that the heel device is not necessarily a separate piece or accessory and would generally not be used as shown in these figures. The present invention contemplates that the heel device will be incorporated into a shoe and will become part of the structure of the shoe as seen later in FIGS. 11-13. An alternative embodiment of the heel device of the present invention which is comprised of two pieces is illustrated in FIGS. 14-16. An example of a commercial product embodying the present invention is the Nike™ 100 D-Gris Women's Running Shoe.

Referring to FIGS. 1-3, heel device 100 is formed of a resilient material and comprises a bottom bridge portion 102 extending underneath the foot. Along each side of the foot, the heel element includes an inclined portion 104 which extends upward and rearward from the forward edge. Inclined portions 104 oppose one another and each continues past the heel and at the rear of the heel each extends downward to form a rear portion 106 that engages the back of the heel of the wearer. Each rear portion 106 is integrated with rear bridge portion 108 extending underneath the heel area of the foot.

The advantages of the construction and placement of heel element 100 will become more apparent within the context of the anatomy of the foot and the empirical data regarding the variability in the proportions of the male and female feet as concerns the heel area in particular.

Figure 4:
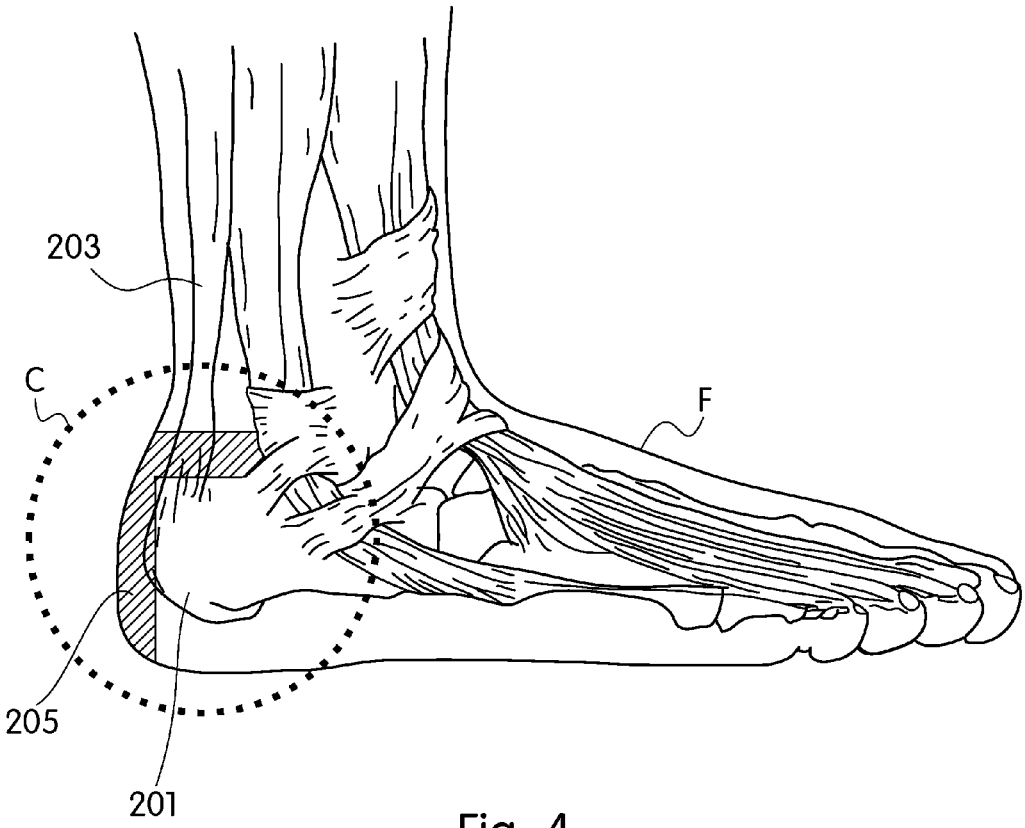
FIG. 4 is a schematic side view of a foot showing the position of the heel bone.

Referring now to FIG. 4, some of the main anatomical features of foot F are illustrated schematically along with a dotted circle C surrounding the heel portion of the foot. A highlighted area 205 is superimposed along the rear of the heel to illustrate the areas where a high degree of variability is observed. A human foot comprises 26 bones defining three regions referred to as the rearfoot, the midfoot and the forefoot. The rearfoot is comprised of the calcaneus or heel bone 201 which is the largest bone in the foot, and the talus (not shown) which is arranged on top of the calcaneus and forms the pivot portion of the ankle joint. The talus is the highest bone in the foot. The midfoot region includes five of the seven tarsal bones: the navicular, cuboid and the three cuneiforms. The forefoot region includes the five metatarsal bones and the phalanges or toes. The joints between each of the metatarsals and the phalanges along with the sesamoid bone on the medial-most joint taken together account for the widest portion of an average foot. This is width measurement W, marked in FIG. 3, which is commonly taken when feet are measured for width sizing.

There are three arches in the foot including the inner or medial arch, the outer or lateral arch and the transverse arch in the forefoot. Ligaments connect the bones together and provide stability to the joints. Numerous ligaments support the arches and stabilize the bones. These ligaments are on all aspects of the foot including the top or dorsal aspect, the bottom or plantar aspect and the medial and lateral aspects. One of the key structures in the foot is the plantar fascia which is a set of strong connective tissue that runs along the bottom of the foot connecting the heel to the base of the phalanges.

The plantar fascia helps support the medial and lateral arches of the foot by locking and stabilizing the bones into place when weight is applied.

There are two groups of muscles in the foot: intrinsic and extrinsic. The intrinsic muscles are located within the foot and control movement of the phalanges or toes. Intrinsic muscles include the plantar flexors, dorsiflexors, abductors, and adductors of the toes. Several intrinsic muscles also help to support the arches of the foot. Extrinsic muscles are located outside the foot in the lower leg, with the powerful gastrocnemius or calf muscle among them. These muscles have long tendons that cross the ankle and attach to the bones of the foot to assist in movement. An example of one of these tendons is the calcaneal tendon 203 in FIG. 4, commonly referred to as the Achilles tendon, which attaches to the calcaneus to the gastrocnemius and soleus muscles in the calf. These are the muscles that play the largest role in propulsion.

The final anatomical structures of the foot to be discussed herein are the built-in cushions and shock absorbers. The first type of cushions or shock absorbers are the fat pads arranged on the bottom of the foot. These fat pads act as cushions and shock absorbers. The largest of the fat pads is located in the heel, directly underneath the calcaneus. The second type of cushions are bursae which are small fluid filled sacs arranged in various locations on the foot. Bursae decreases the friction between two tissues and protects bony structures. Normally a bursa has very little fluid in it, but if it becomes irritated or injured, it can fill with fluid resulting in swelling. One bursa that is commonly injured is the one located at the back of the calcaneus called the superficial calcaneal bursa. Although the heel is a bony structure due to the sheer size of the calcaneus, the fat pads and bursae surrounding it lend it a heel width HW, also marked FIG. 3, which is made up of all of these structures.

As discussed above, the common width measurement W is taken along the metatarsals-phalanges joints. In contrast, the width of the heel, HW, is generally not taken at all when fitting shoes, and is not taken in account generally when shoes are designed. Empirical data shows that the difference between the forefoot width W and the heel width HW is greater in female feet than in male feet. This means that footwear designed for the proportions of male feet will generally have a heel pocket that is too large for female feet of a corresponding forefoot width. This results in slippage, and may lead to abrasions or blisters from the ill-fitting shoe slipping and rubbing against the heel area. A close review of the empirical data will be helpful in understanding the advantages of the present invention.

Most previous methods of compiling empirical data on foot dimensions employ anthropometric methods. The term anthropometric refers to comparative measurements of the human body. For feet and ankles, these measurements typically employ certain landmarks and measure the distances between them. One sample use for anthropometric data is in evaluating for growth by comparing individual measurements to reference standards. There is no external objective measure such as a scale, so anthropometric measurements are generally meaningful in the context of other anthropometric reference standards. The U.S. Army conducted a comprehensive anthropometric survey on its personnel in the late 1980's and published various portions and phases. One publication is titled "1988 Anthropometric Survey of U.S. Army Personnel: Summary Statistics Interim Report" dated March 1989. This survey is often referred to as the ANSUR. Because of the volume of information gathered, the data from this survey serves as a benchmark for many recent studies and articles.

Figure 5:
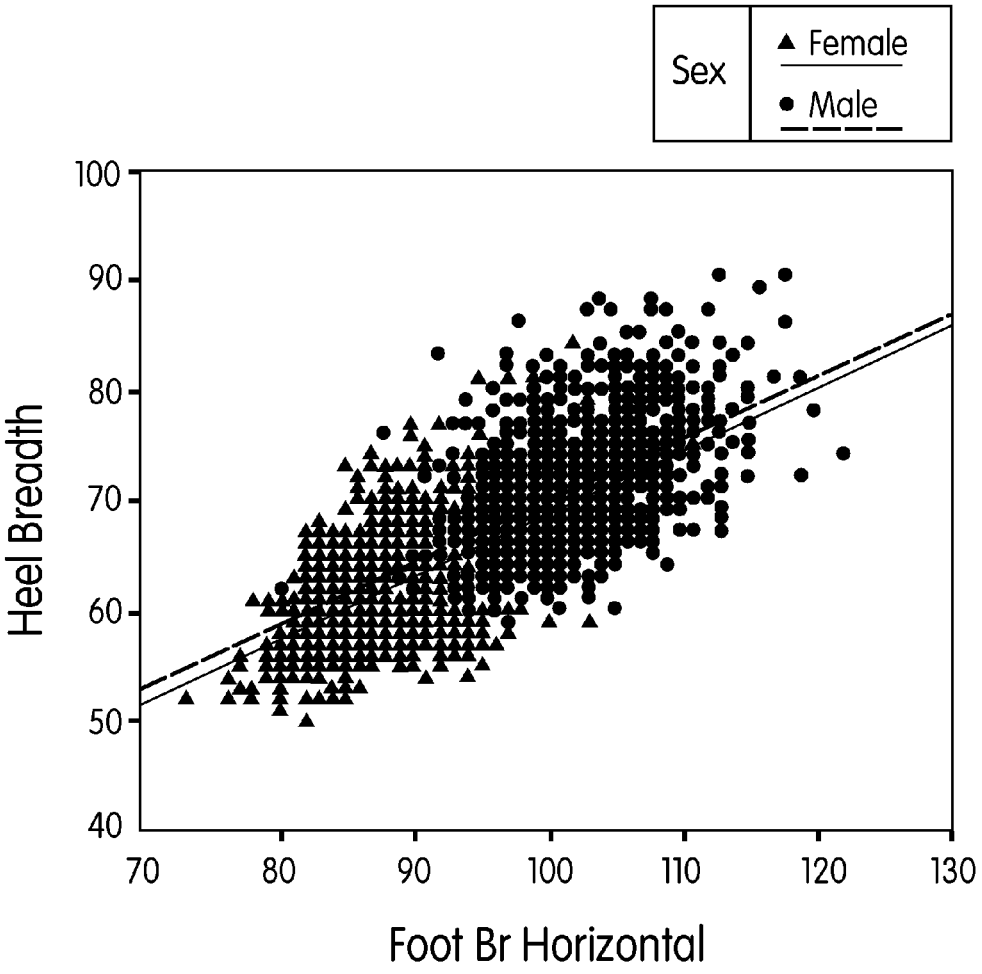
FIG. 5 is a plot of heel breadth vs. forefoot breadth from an anthropometric survey of the foot.

The measurements taken of the feet and ankles of the subjects are shown on page 23 of the Interim Report, and tabulated on pages 96-97 of the Interim Report. This data are shown graphically in FIGS. 5 and 6. A scatter diagram of the foot breadth to heel breadth is provided in FIG. 5, in which the triangles represent female measurements and the circles represent male measurements. FIG. 5 can be interpreted to provide several conclusions about foot size. First, it shows what is generally known, that male feet are wider overall than female feet. In this sample, there are very few female feet with a foot breadth of greater than 95 mm or so. Likewise, there are very few male feet with a foot breadth of less than 95 mm or so. Second, it shows that male and female feet are consistently proportioned by gender, and that there is a rather clear demarcation at around 90-95 mm between female and male measurements. Third, the slopes plotted representing the averages of the scatter data show that the male foot measurements are proportionally larger than the female foot measurements. This means that athletic footwear designed using male forefoot width measurements will generally be too large in the heel area for most female feet, and will be ill-fitting.

Figure 6:
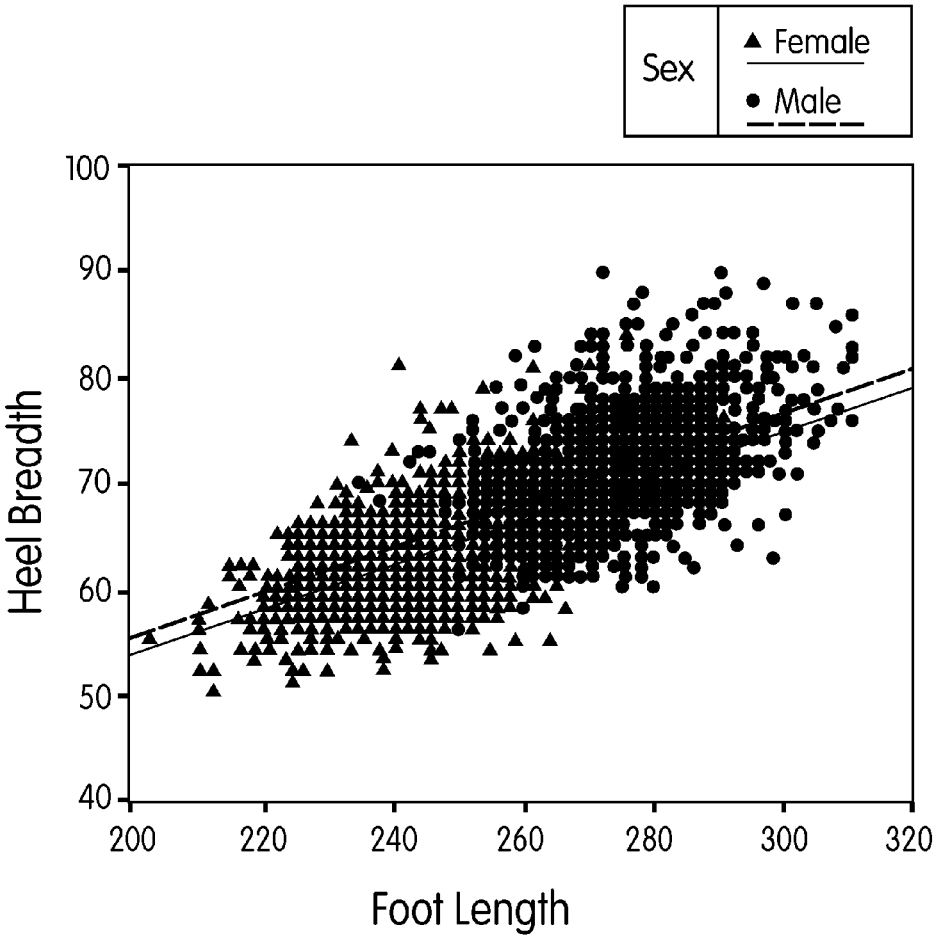
FIG. 6 is a plot of heel breadth vs. foot length from the anthropometric survey of the foot.

FIG. 6 shows the heel breadth HW to the foot length measurements of male and female feet, in which, again, the triangles represent female measurements and the circles represent male measurements. As FIG. 6 shows, the heel breadth vs. foot length measurement comparisons reveal more differences between male and female feet. Not surprisingly the shorter length measurements tend to belong to mostly female feet, and the longer length measurements tend to belong to mostly male feet. It is in the middle region of length measurements, from about 250 mm to 260 mm that the ratios of heel breadth to foot length reveal most starkly the conclusion that women have narrower heels for a given foot length than men. This conclusion is reiterated statistically in the slopes plotted representing the averages of the scatter data. This demonstrates again that athletic footwear designed using assumptions of heel breadth dimensions based on male length measurements will generally be too large in the heel area for most female feet, and will be ill-fitting.

Although anthropometric measurements provide useful data and general conclusions about differences between male and female feet, more differences are observed when male and female feet were studied on a three-dimensional basis to take into account the total volume occupied by the feet. This three-dimensional approach was employed to capture quantitatively the size differences between male and female feet, and variability in different feet measured to be a single size, with particular focus on the heel area. The measurement area is illustrated schematically in FIG. 7 and the results are tabulated graphically in FIGS. 8 and 9 to demonstrate the variability in the measurements.

Figure 7:
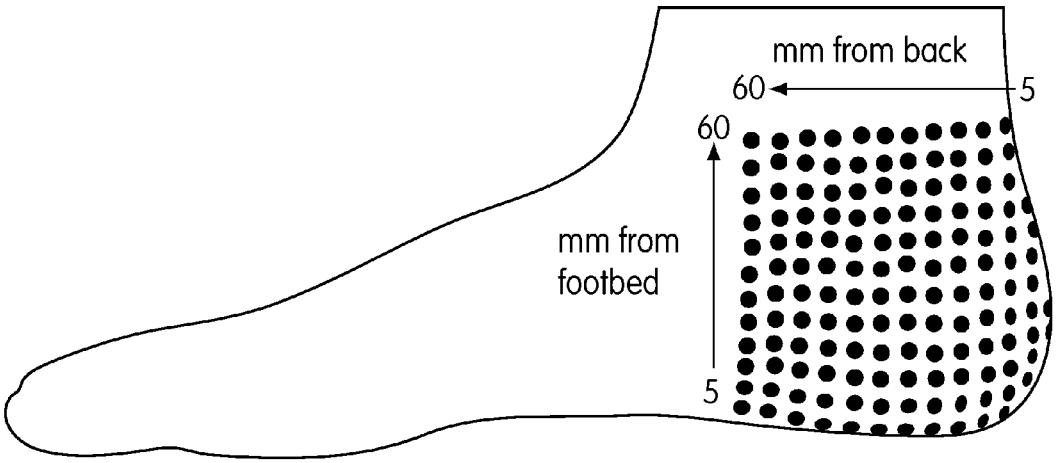
FIG. 7 is a schematic side view of a foot showing a dimensioned grid superimposed thereon to illustrate a new way of measuring the volume of the foot.

As FIG. 7 shows, two sets of measurements were taken: a first set relative to the bottom of the foot measured as distance from the footbed; and a second set relative to the heel of the foot measured as distance from the back of the foot. A summary of the measurements are tabulated in FIG. 8 in corresponding positions with the schematic diagram of FIG. 7. The results demonstrate that the measurements closest to the heel have the largest difference between men's feet and women's feet. For example, at 10 mm up from the footbed, and 10 mm forward of the back of the foot, the difference between male and female feet was between 3.5 mm and 5.9 mm. The areas with the greatest differences shown on the table represent the heel and Achilles areas of the foot in which female feet are smaller than male feet. In contrast, at either 20 mm or 30 mm up from the footbed, and at 50 mm from the back of the foot, the difference was much smaller, between −1.5 mm and 1.9 mm. This means that male and female feet were about the same width at these particular points. The measurement data shows that from 40 mm to 60 mm from the back of the foot, the differences are minimal. The differences start to increase somewhat around 40 to 20 mm from the back of the foot. Interestingly, at 60 mm up from the footbed, and 10 mm forward of the back of the foot, the difference was between −1.5 mm and 1.9 mm. Any negative values meant that female feet were wider at those points than male feet. The subjects were 26 men with men's size 9 feet, and 51 women with women's size 7 feet. In summary, the tabulated results in FIG. 8 show that the closer to the heel and the closer to the footbed, the differences in width between male and female feet are the greatest.

Figure 9:
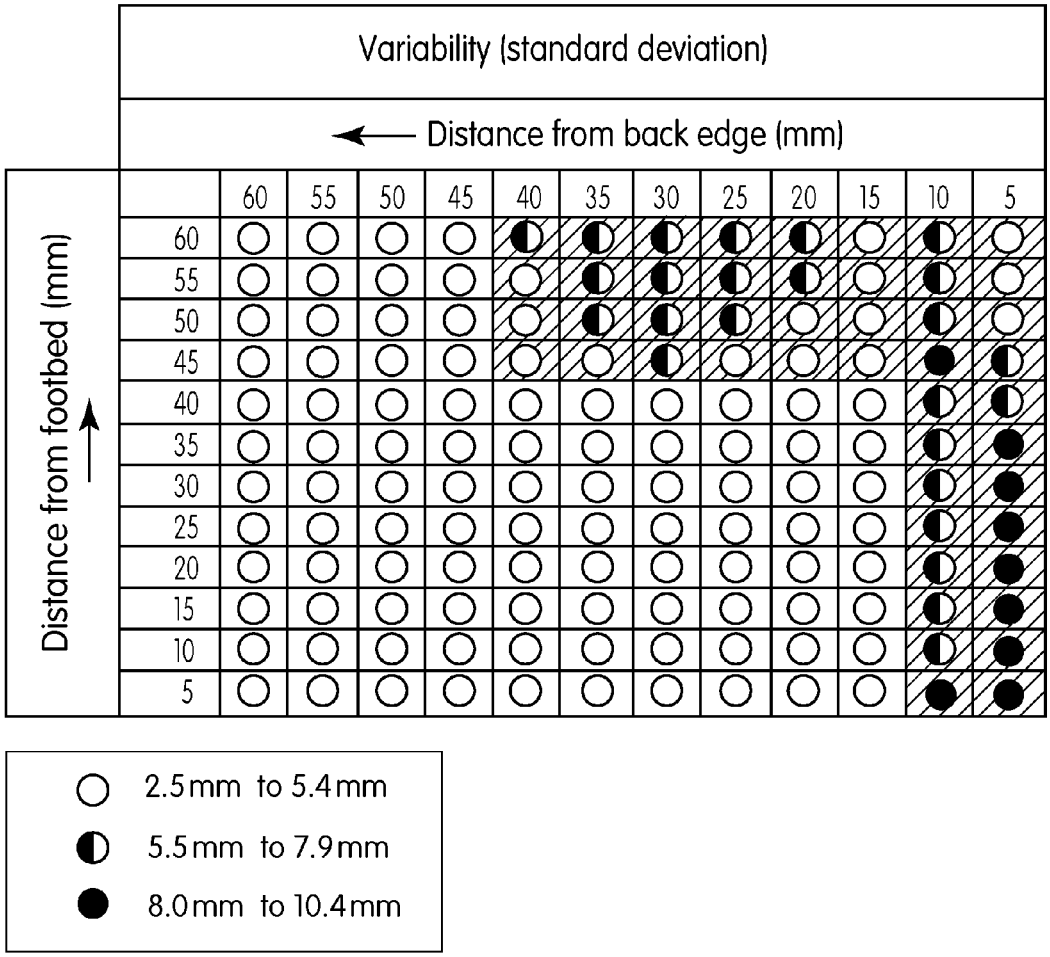
FIG. 9 contains Table 2: Variability of the Female Heel showing a statistical analysis of the measurements taken in conjunction with the grid in FIG. 7.

Interestingly the three-dimensional measurement arrangement was employed to measure just a group of female feet. The results of the all-female foot measurements taken long the grid of FIG. 7 are graphically represented it the table of FIG. 9. Instead of the differences, FIG. 9 shows the variability by standard deviation. The statistical terms used in this application should be given their commonly understood definitions. That is, that standard deviation is an acceptable way to measure dispersion of data points; that the smaller the standard deviation, the closer the data points are to a statistical mean; and conversely, that the larger the standard deviation, the more widely dispersed the data points are from the statistical mean. It should be noted that the tabulated results in FIG. 9 are formatted like FIG. 8 to correspond roughly to the positions on the dimensioned grid of FIG. 7. The sample group consisted of 24 women all having women's size 7 feet. An examination of FIG. 9 reveals that the lowest standard deviations occur in two areas, a first area bounded by 40-45 mm from the footbed and 55-60 mm from the back of the foot; and a second area corresponding to about 30-40 mm from the back of the foot and 20 mm and less from the footbed. The highest standard deviations occur at the rear of the foot, within 10 mm from the back of the foot. This shows again even among women with the same sized feet, the variability in the volumes of the heel areas are striking and go a long way to explain all of the pads and accessories sold to enhance fit.

These statistical analyses explain the placement of highlighting 205 in FIG. 4 which illustrates graphically the areas in which the most variability has been observed. Roughly this same area is shaded on FIG. 9 to represent the areas in which the variability has been observed.

For athletes and non-athletes alike, male and female, whose feet measurements fall outside of the statistical average length and forefoot breadth proportional combinations, conventionally designed athletic shoes are ill-fitting in the heel area. The drawbacks can range from the vaguely unsatisfactory feel of a loose heel fit, to irritations like abrasions and blisters, to serious injuries from the feet coming loose from the shoe and landing awkwardly or abruptly during jumping and landing or quick movements. To allay these fit issues in the heel area, a heel device is incorporated into athletic footwear to tighten around the heel while avoiding irritating the calcaneus itself or its attendant fat pads and bursae, and provide a more secure fit.

Heel device 100 is illustrated schematically on a foot in FIG. 10, similar to FIG. 4, but this time showing some of the internal structures of the foot. As can be seen in FIG. 10, from bottom bridge 102, front leg 110 extends upward from the footbed and merges with inclined side 104 at front transition angle 112. From transition angle 112 inclined side 104 extends upward and rearward from toward a rear transition angle 114 the bottom bridge 102 so that the bulk of the calcaneus or heel bone 201 is located underneath inclined sides 104. This means that the bulky end portion of heel bone where the fat pads and bursae are located around the bony end of the heel bone are contained by heel device 100. Inclined sides 104 engage the foot some distance above the footbed, preferably where the foot narrows again above the bony end of the calcaneus. In this manner, heel device 100 avoids rubbing against the calcaneus or its attendant fat pads or bursae but instead outlines and surrounds the bulbous end of the heel. In the rear, rear portions 106 extend downward from rear transition angle 114 with the two rear portions joining and terminating at rear bridge portion 108 which underlays the heel bone.

As described above, heel device 100 is made of a resilient material and formed so that the inclined sides are biased toward each other. The shape of the heel device, in particular the locations of the inclined portions and the front and rear transition angles, is devised with consideration of the measurement data. When the heel device is incorporated into the structure of a shoe this means that the inclined sides slightly grip the back of the wearer's foot to provide a more secure and snug fit. Specifically, the resilient material of the heel device operates to bias the ankle collar padding closer to the narrower area just above the heel bone.

Figure 11:
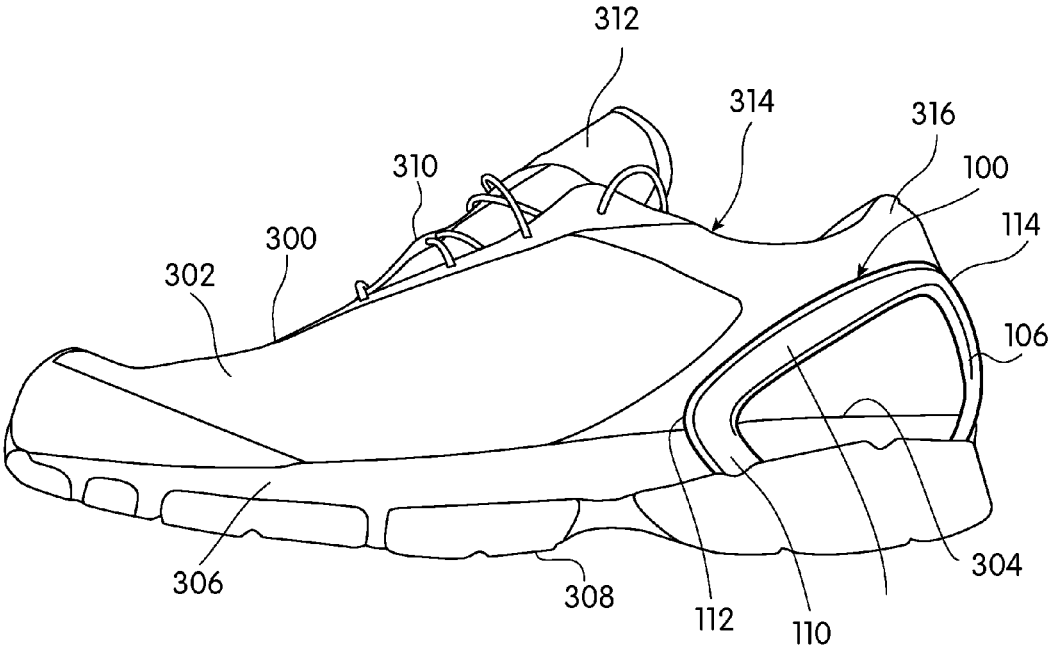
FIG. 11 is a side elevational view of a shoe including a heel device in accordance with the present invention.
Figure 12:
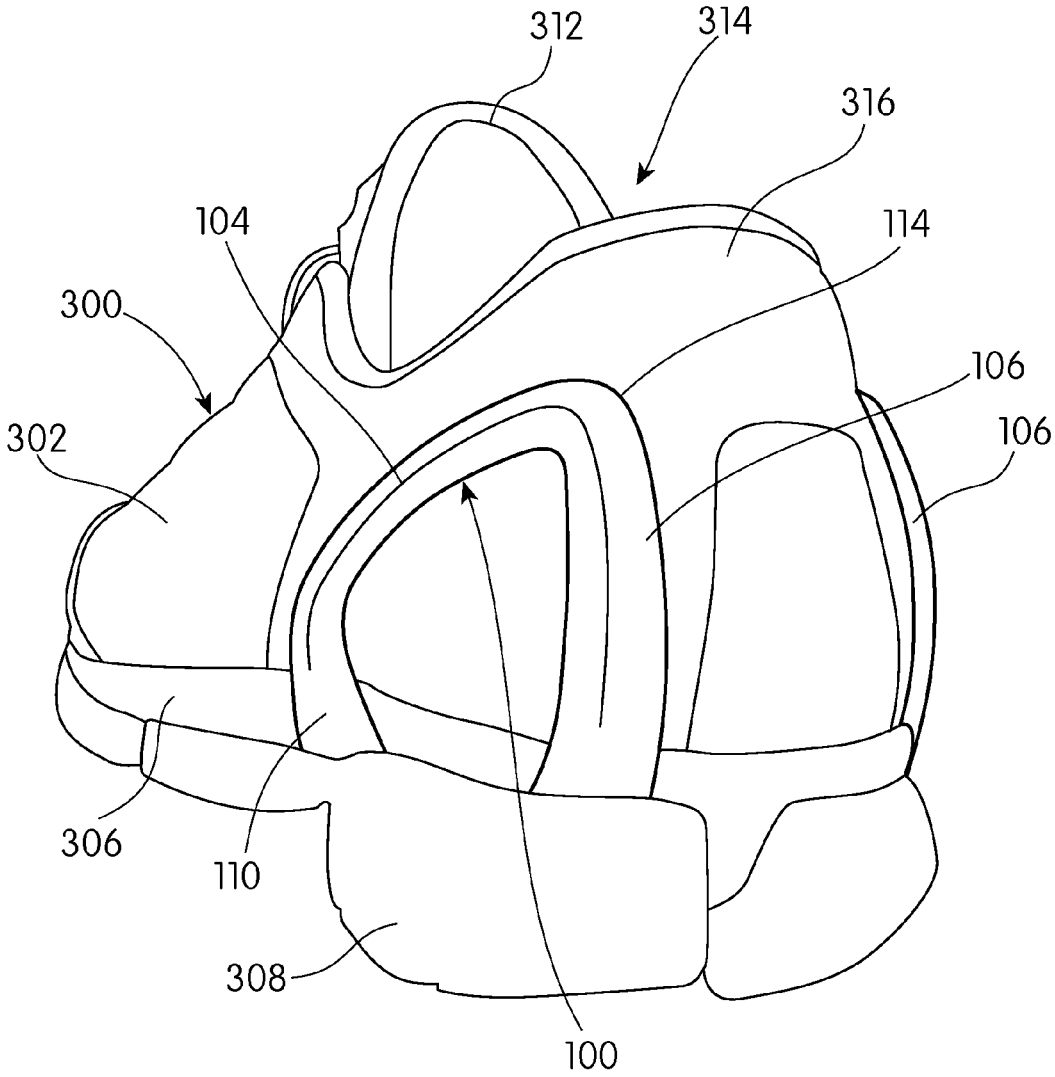
FIG. 12 is a rear perspective view of the shoe of FIG. 11, shown favoring the lateral side.
Figure 13:
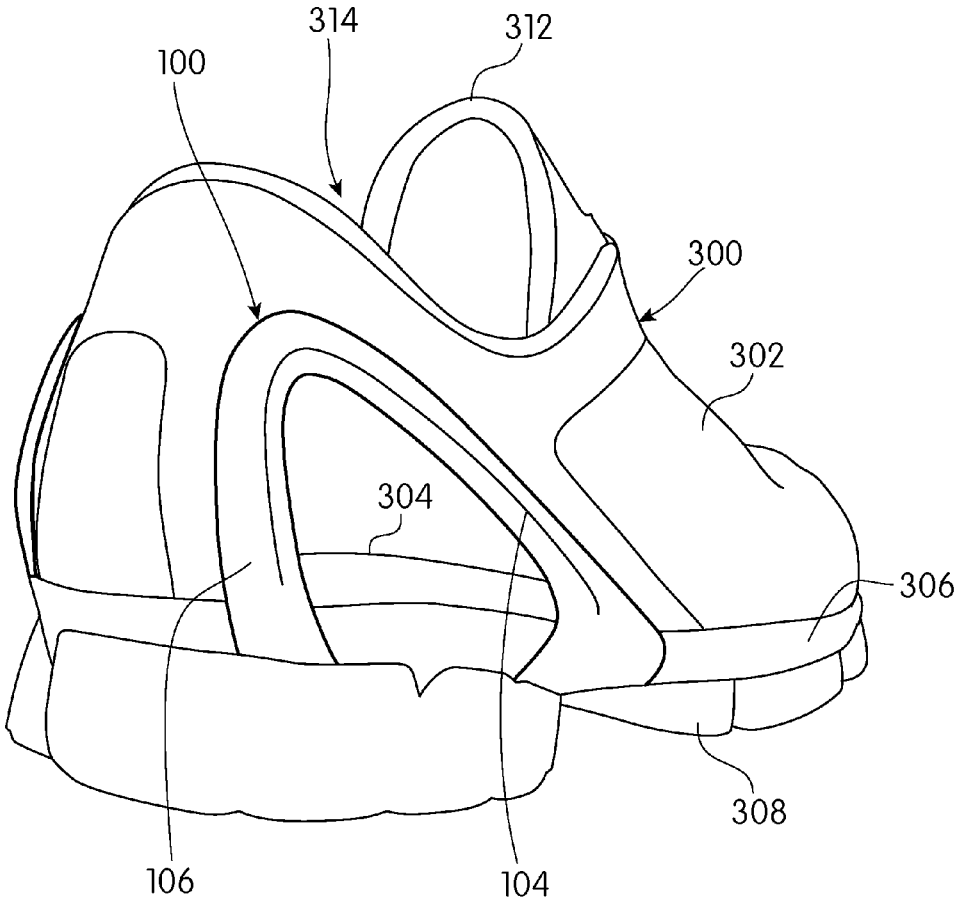
FIG. 13 is another rear perspective view of the shoe of FIG. 11, shown favoring the medial side.
Figure 14:
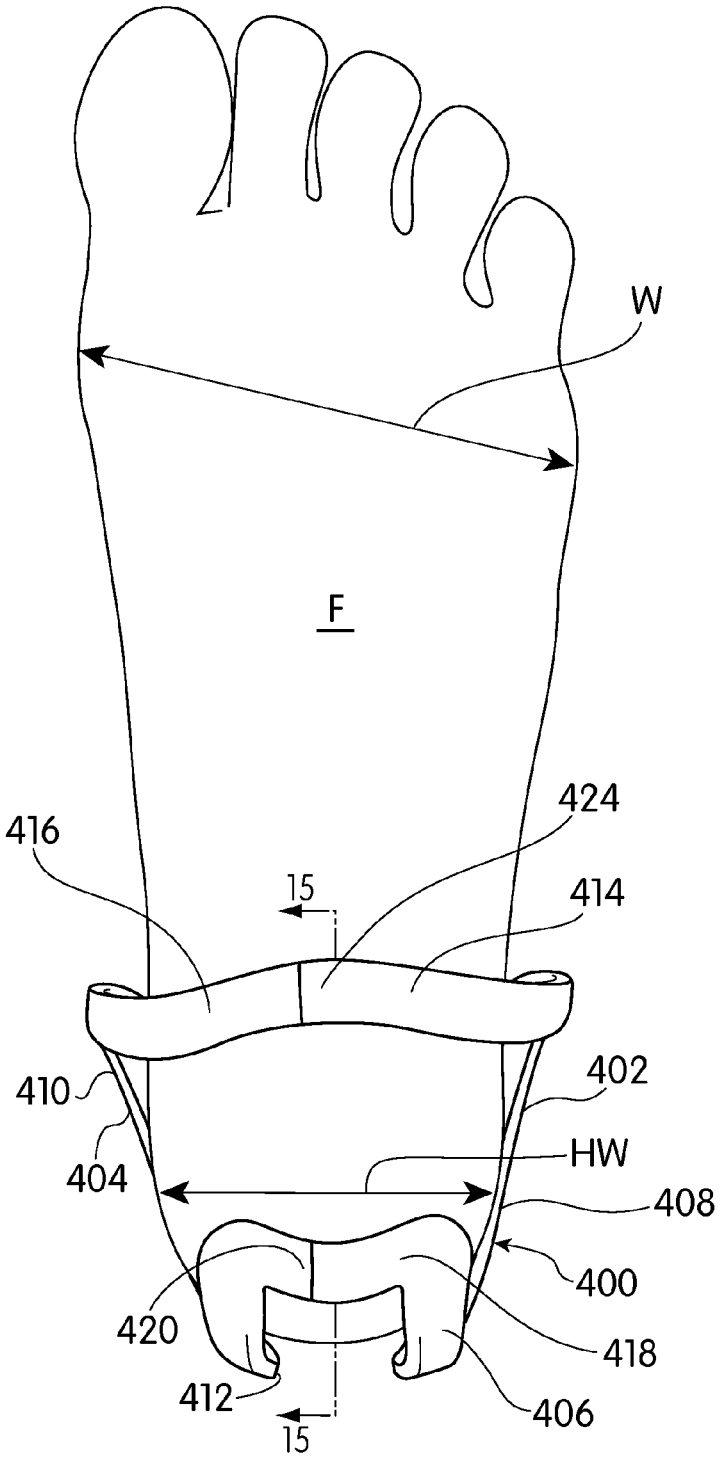
FIG. 14 is a bottom plan view similar to FIG. 3 but illustrating a two-piece heel device representing an alternative embodiment of the present invention.

FIGS. 11-13 illustrate a shoe 300 incorporating heel device 100 into the rear foot construction. Shoe 300 comprises a shoe upper 302 for surrounding at least a portion of a wearer's foot, and a sole unit to support the foot including an insole 304, a cushioning midsole 306, and an outsole 308 for providing traction and extended wear. Upper 302 can include a lacing area 310 including a tongue 312 underlying the lace opening. To receive the foot into the shoe, upper includes an opening 314 which generally has a padded ankle collar 316 surrounding the top edge to provide a comfortable contact area for the wearer's foot and ankle. Because heel device 100 is attached to upper 302 with the bottom bridge and rear bridge portions installed on midsole 306, the lower portions of the heel device are now visible when the device is incorporated into a shoe.

To obtain even more benefit of the heel device's inwardly biased design, when the heel device is incorporated into a shoe, the size of the heel device is selected to be smaller than the size of the finished shoe. The heel device is contemplated to be manufactured in shoe sizes using the same proportions and dimensions used to size shoes. By using a smaller heel device, for example, using a size 6 device in a size 7 shoe enhances the biasing effect of the inclined portions toward one another to snugly engage the heel area of the wearer's foot. This enhanced biasing effect will comfortably ensure a secure fit for a larger range of heel volumes within the same shoe size. During construction, the heel device is attached to the upper of the shoe and underneath the insole.

Although heel device 100 has been illustrated to be a single piece unitary device, the same advantages can be attained and manufacture facilitated by employing a two-piece heel device. FIGS. 14-16 illustrate the multiple-piece embodiment of the heel device. FIG. 14 is similar to FIG. 3 in illustrating a heel device 400 schematically on a foot F.

Figure 15A:
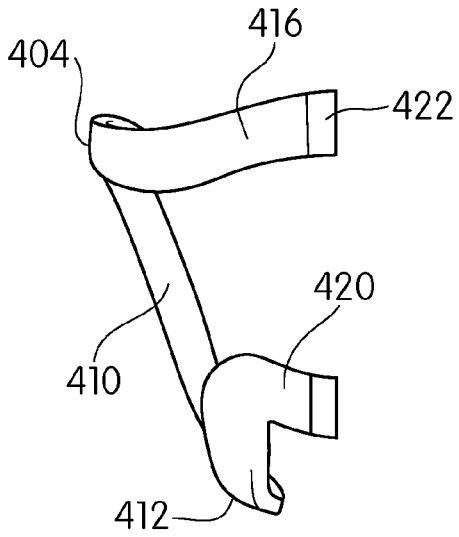
FIG. 15A is a bottom plan view of the medial portion of the two-piece heel device of FIG. 14.
Figure 15B:
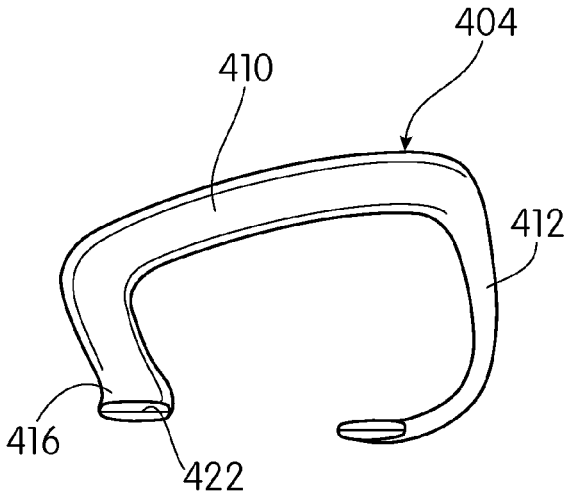
FIG. 15B is an interior side view of the medial portion of FIG. 15A viewed from line 15B-15B in FIG. 14.
Figure 16:
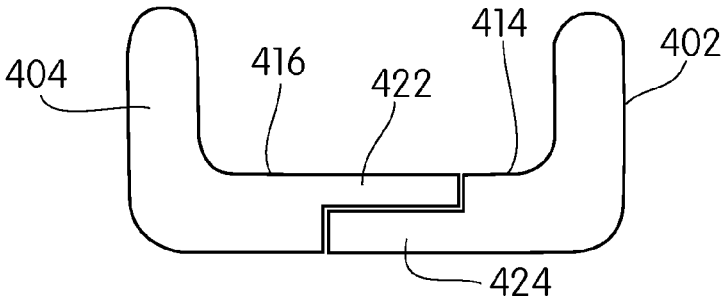
FIG. 16 is a schematic front view of the two-piece heel device of FIG. 14 showing the joint area between the medial and lateral portions in detail.

Referring to FIGS. 14-16, heel device 400 comprises a lateral segment 402 and a medial segment 404 both made of resilient material. As seen in FIGS. 15A and 15B, the two segments are largely mirror images of one another with each resembling half of heel device 100, FIGS. 11-13. Lateral segment 402 has an inclined portion 406 and a rear portion 408. Likewise medial segment 404 has an inclined portion 410 and a rear portion 412. Each segment also has its own bottom portion: lateral bottom portion 414 and medial bottom portion 416. Similarly, each segment has it own rear bridge portion, lateral rear bridge portion 418 and medial rear bridge portion 420. The lateral and medial segments of heel device 400 are joined together in two locations underneath the foot: once at the bottom bridge portion and again at the rear bridge portion. As best seen in FIGS. 15A, 15B and 16, lateral and medial segments 402 and 404 are configured with an overlapping joint underneath the foot. The free ends of the lateral and medial segments are formed with a stepped portion which overlaps with a mating stepped portion of the opposite segment. Referring to the figures, medial segment 404 at the free end of its bottom portion 416 has a step 422 having approximately half the thickness of bottom portion 416. As best seen in FIG. 16, the free end of lateral bottom portion 414 also has a step 424 having approximately half the thickness of bottom portion 414. Medial step 422 and lateral step 424 overlap one another and are attached at the joint to one another and to the shoe such that heel device 400 functions the same as one-piece heel device 100. The joint of lateral rear bridge portion 418 to medial rear bridge portion 420 to form the rear bridge is the same as the joint forming the bottom bridge of heel device 400. It should be noted that these figures are detailed schematic views since the actual scale of the device and its thickness as shown in FIG. 16 would be quite small, on the order of a few millimeters thick at the bottom bridge.

Two-piece heel device 400 is easier to incorporate into the shoe's construction since there is more flexibility available with respect to manufacturing steps and the sequence of assembly when the two segments can be attached to the upper of the shoe separately and then joined together underneath the insole. The two segments enable more freedom of movement during the manufacturing process which can speed assembly and streamline the sequences. This is especially true when the heel device is sized smaller than the shoe into which it is incorporated since the manufacturing process must take into account not only the natural biasing effect of the heel device, but the enhanced biasing effect of using a too-small heel device for the size of shoe.

In the illustrated embodiment the lateral and medial segments are joined together in two locations underneath the foot: at the bottom bridge portion and the rear bridge portion. It is possible that the heel device could be designed in two segments with a single joint underneath the foot and still produce all of the benefits of the present invention, and such a configuration is contemplated to be within the scope of the present invention. It is also contemplated that the lower bridge portions of the heel device could also be visible in areas where the bottom of the shoe upper is visible when viewed from the bottom of the shoe.

The position of the heel device relative to the foot of the wearer is the same as shown schematically in FIGS. 1 and 4. This is also true of the function of the device in which inclined portions which are biased toward one another to close about the heel area of the wearer to provide a more secure and comfortable fit. Because the shoe upper is generally made of a pliable material such as fabric or leather, the amount of force by which the heel device is biased does not need to be great, just sufficient to close the heel device around the heel of the wearer. A better fit in the heel area not only prevents irritations, but can also prevent serious injuries by keeping the foot engaged inside of the shoe with all of its protective and cushioning properties. The resilient heel device could be made from a variety of suitable plastic or nylon materials. Non-plastic materials such as fiberglass could also be used to exert the same desired properties.

In the illustrated embodiment, the shoe is an enclosure that surrounds the foot of the wearer and is provided with cut-outs in the space defined by inclined portions 104, FIGS. 11-13. These cut-outs could also be covered by material to completely enclose the foot. It is also possible that the heel device itself be covered by material for design or functional considerations, and not be visible from the outside or inside of the shoe. It is also contemplated that the heel device of the present invention could be used on sandal, clog or mule style so that it stands upward from the footbed area by itself with some padding or other comfortable material on the interior surfaces to function as a biased stand-alone heel clip.

Figure 17:
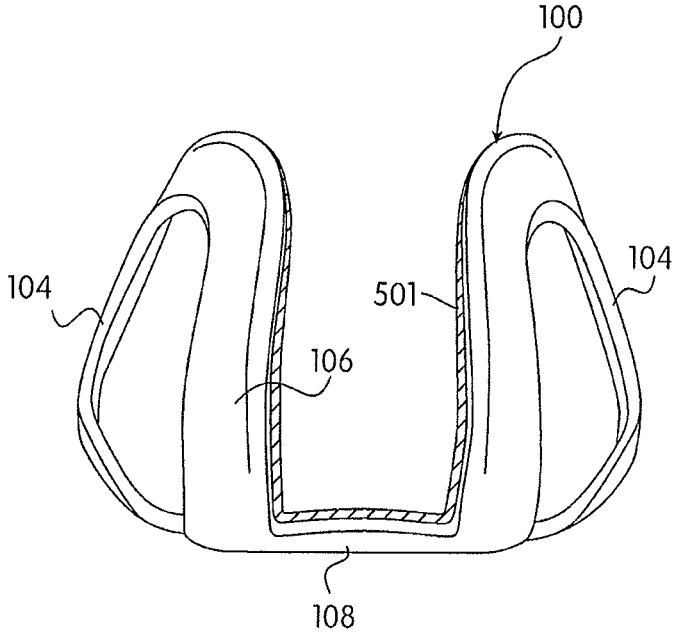
FIG. 17 is a rear elevational view of the heel device similar to FIG. 2, but showing an additional padding layer.

FIG. 17 shows an embodiment of the heel device 100 having a padded layer 501 to comfortably engage the heel of a foot.

While various embodiments of the invention have been described, it will be apparent to those of ordinary skill in the art that may more embodiments and implementations are possible that are within the scope of the invention.

What is claimed is:

1. An athletic shoe defining a forefoot region, a midfoot region and a rearfoot region and adapted to receive a wearer's foot having corresponding anatomical regions, the shoe comprising:

an upper for surrounding at least a portion of the midfoot region of the wearer's foot, and including an insole forming a bottom of the upper providing a receiving surface for the sole of the wearer's foot;

a midsole attached to the upper for providing cushioning and stability;

an outsole having a tread surface for providing ground-engaging traction and stability; and a resilient heel device attached to and incorporated into the shoe in the rearfoot region, the heel device having a medial segment and a lateral segment biased towards each other and attached to the upper, the medial segment and the lateral segment attached to one another at a first joint along a bottom bridge of the heel device and at a second joint along a rear bridge of the heel device, the bottom bridge and the rear bridge both underlying the upper and attached to the shoe between the upper and the midsole.

2. The shoe of claim 1, wherein the medial segment includes a medial inclined portion and a medial rear portion extending from the medial inclined portion and the lateral segment includes a lateral inclined portion and a lateral rear portion extending from the lateral inclined portion.

3. The shoe of claim 2, wherein the medial segment includes a medial rear bridge portion extending from the medial rear portion and the lateral segment includes a lateral rear bridge portion extending from the lateral rear portion, the medial rear bridge portion and the lateral rear bridge portion together forming the rear bridge of the heel device.

4. The shoe of claim 3, wherein a free end of the medial rear bridge portion includes a medial stepped portion and a free end of the lateral rear bridge portion includes a lateral stepped portion configured to overlap and mate with the medial stepped portion.

5. The shoe of claim 4, wherein a thickness of the medial stepped portion is less than a thickness of the rest of the medial segment and a thickness of the lateral stepped portion is less than a thickness of the rest of the lateral segment.

6. The shoe of claim 1, wherein the medial segment includes a medial inclined portion and a medial bottom portion extending from the medial inclined portion and the lateral segment includes a lateral inclined portion and a lateral bottom portion extending from the lateral inclined portion.

7. The shoe of claim 6, wherein the medial segment includes a medial bottom portion and the lateral segment includes a lateral bottom portion, the medial bottom portion and the lateral bottom portion together forming the bottom bridge of the heel device.

8. The shoe of claim 7, wherein a free end of the medial bottom portion includes a medial stepped portion and a free end of the lateral bottom portion includes a lateral stepped portion configured to overlap and mate with the medial stepped portion.

9. The shoe of claim 8, wherein a thickness of the medial stepped portion is less than a thickness of the rest of the medial segment and a thickness of the lateral stepped portion is less than a thickness of the rest of the lateral segment.

10. The shoe of claim 1, wherein the bottom bridge is wider than the rear bridge.

11. An athletic shoe defining a forefoot region, a midfoot region and a rearfoot region, the rearfoot region comprising a heel cup and adapted to receive a wearer's foot having corresponding anatomical regions, the heel cup adapted to receive a bulbous end of a wearer's heel bone, the shoe comprising:

an upper for surrounding at least a portion of the midfoot region of the wearer's foot, and including an insole forming a bottom of the upper providing a receiving surface for the sole of the wearer's foot;

a midsole attached to the upper for providing cushioning and stability;

an outsole having a tread surface for providing ground-engaging traction and stability;

a resilient heel device attached to and incorporated into the shoe in the rearfoot region by attachment to the upper and to the midsole, the heel device having a lateral segment and a medial segment biased toward each other and attached to the upper proximate the heel cup;

wherein the lateral segment includes an upwardly extending lateral forward leg having a forwardmost point at a front transition angle and an upwardly extending lateral rear portion spaced from the lateral forward leg and having an uppermost point at a lateral rear transition angle and a lateral inclined portion extending upwardly and rearwardly from the lateral front transition angle to the lateral rear transition angle;

wherein the medial segment includes an upwardly extending medial forward leg having a forwardmost point at a front transition angle and an upwardly extending medial rear portion spaced from the medial forward leg and having an uppermost point at a medial rear transition angle and a medial inclined portion extending upwardly and rearwardly from the medial front transition angle to the medial rear transition angle; and wherein the lateral segment and the medial segment are attached to one another by a first joint disposed between the lateral rear portion and the medial rear portion.

12. The shoe of claim 11, wherein the lateral segment and the medial segment are attached to one another by a second joint disposed between the lateral forward leg portion and the medial forward leg portion.

13. The shoe of claim 12, wherein the lateral rear transition angle, the lateral forward leg, the lateral rear portion, the lateral incline portion, the medial rear transition angle, the medial forward leg, the medial rear portion, and the medial incline portion together define an aperture.

14. The shoe of claim 11, wherein the shoe has a size and the heel device is sized smaller than the size of the shoe to enhance the biasing effect of the lateral segment and the medial segment.

15. The shoe of claim 11, wherein the medial segment includes a medial rear bridge portion extending from the medial rear portion and the lateral segment includes a lateral rear bridge portion extending from the lateral rear portion, the medial rear bridge portion and the lateral rear bridge portion together forming a rear bridge of the heel device.

16. The shoe of claim 15, wherein the medial segment and the lateral segment are attached by a second joint disposed between the medial forward leg and the lateral forward leg.

17. The athletic shoe of claim 11, wherein each of the medial and lateral segments of the heel device defines a C-shape.

18. An athletic shoe defining a forefoot region, a midfoot region and a rearfoot region, the rearfoot region comprising a heel cup and adapted to receive a wearer's foot having corresponding anatomical regions, the heel cup adapted to receive a bulbous end of a wearer's heel bone, the shoe comprising:

an upper for surrounding at least a portion of the midfoot region of the wearer's foot, and including an insole forming a bottom of the upper providing a receiving surface for the sole of the wearer's foot;

a midsole attached to the upper for providing cushioning and stability;

an outsole having a tread surface for providing ground-engaging traction and stability;

a resilient heel device attached to and incorporated into the shoe in the rearfoot region by attachment to the upper and to the midsole, the heel device having a lateral segment and a medial segment biased toward each other and attached to the upper proximate the heel cup;

wherein the lateral segment includes an upwardly extending lateral forward leg, an upwardly extending lateral rear portion configured to engage the back of the heel of the wearer, a lateral rear bridge portion extending from the lateral rear portion, and a lateral inclined portion joining the lateral forward leg to the lateral rear portion;

wherein the medial segment includes an upwardly extending medial forward leg, an upwardly extending medial rear portion configured to engage the back of the heel of the wearer, a medial rear bridge portion extending from the medial rear portion, and a medial inclined portion joining the medial forward leg to the medial rear portion; and wherein the lateral segment and the medial segment are attached to one another by a first joint disposed between the lateral rear bridge portion and the medial rear bridge portion.

19. The shoe of claim 18, wherein the lateral segment and the medial segment are attached to one another by a second joint disposed between a medial bottom portion extending from the medial forward leg and a lateral bottom portion extending from the lateral forward leg.

20. The athletic shoe of claim 18, wherein the lateral forward leg, the lateral rear portion, and the lateral inclined portion together define a C-shape and the medial forward leg, the medial rear portion, and the medial inclined portion together define a C-shape.

* * * * *